United States Patent [19]

Kronogard

[11] 3,930,746

[45] Jan. 6, 1976

[54] OUTLET DIFFUSOR FOR A CENTRIFUGAL COMPRESSOR

[75] Inventor: Sven-Olof Kronogard, Lomma, Sweden

[73] Assignee: United Turbine AB & Co., Kommanditbolag, Malmo, Sweden

[22] Filed: June 11, 1974

[21] Appl. No.: 478,390

[30] Foreign Application Priority Data

June 18, 1973 Sweden ..... 84915/73

[52] U.S. Cl. ..... 415/149; 415/207; 415/211; 415/DIG. 1

[51] Int. Cl.[2] ..... F01D 17/00; F04D 29/46

[58] Field of Search ..... 415/211, 160, 149, DIG. 1, 415/219 C, 186, 152

[56] References Cited

UNITED STATES PATENTS

| | | | |
|---|---|---|---|
| 2,439,933 | 4/1948 | Jenkins | 415/211 |
| 2,645,410 | 7/1953 | Bauger et al. | 415/149 |
| 2,708,883 | 5/1955 | Keller et al. | 415/219 C |
| 3,132,594 | 5/1964 | Shiley et al. | 415/211 |
| 3,333,762 | 8/1967 | Vrana | 415/211 |
| 3,778,186 | 12/1973 | Bandukwalla | 415/211 |
| 3,860,360 | 1/1975 | Yu | 415/211 |
| 3,873,232 | 3/1975 | Stein et al. | 415/207 |

FOREIGN PATENTS OR APPLICATIONS

| | | | |
|---|---|---|---|
| 963,540 | 1/1950 | France | 415/DIG. 1 |

*Primary Examiner*—Henry F. Raduazo
*Attorney, Agent, or Firm*—Holman & Stern

[57] ABSTRACT

An outlet diffusor for a centrifugal compressor built up from two planar discs and a number of elements shaped as segments of a circle interposed therebetween; each element is defined by two opposed shaped edge faces, which together with corresponding faces in adjacent segments form tubular passages in the diffusor; the geometrical form of these passages may be varied by altering the cross section of the channels or the spacing between the segments, and by mounting the segments so they are angularly adjustable so that the flow characteristics of the diffusor may be altered and during use.

6 Claims, 7 Drawing Figures

OUTLET DIFFUSOR FOR A CENTRIFUGAL COMPRESSOR

BACKGROUND OF THE INVENTION

A centrifugal compressor is often provided with an outlet diffusor, which may be of the passage or of the vane type. A common example of the first type is the so called tubular passage diffusor, which basically consists of a number of inclined, radial passages formed in a plane disc, for instance by boring or by milling.

Most tubular diffusors are expensive to manufacture due to the high precision necessary, and it is very difficult to machine the substantially edge-shaped portion between the entrances to two adjacent passages. The diffusor, further, is often manufactured from light metal, so sand and other foreign matter passing through the filter, usually located at the entrance to the compressor, will rapidly wear down these edge-shaped portions. If the diffusor is produced as an integral unit, repairs are impossible. If, on the other hand, the diffusor is composed of a number of separate components having thin sections and limited sealing areas it will be difficult to prevent leakage transversely to the main direction of flow at these edge-shaped portions. With tubular diffusors of known type, finally, it has not been possible, during actual use, to perform any adjustment of the passages and of the flow characteristics in order to influence surge or choking, respectively, as well as of the efficiency between these two border values.

SUMMARY OF THE INVENTION

Due consideration to above mentioned facts will, however, be taken, if the diffusor according to the invention includes a number of elements, each formed as a segment of a circle, and each defined by two channel-shaped edge faces meeting at the edge of the segment, the segments being fitted between two parallel, planar discs in such a manner that a tubular expansion passage will be formed between confronting edge faces of any two adjacent segments.

A channel shaped side face may be designed as part of the envelope surface of a cylinder or of a cone, or have any other suitable geometric shape. The individual segments may easily be machined or precision cast and may be manufactured from a wear resistant material, at least within its nose portion, or be subjected to surface treatment with the aim of increasing its wear resistant properties with respect to abrading matter carried by the fluid to be compressed. It is finally furthermore possible to arrange the segments so they, wholly or in part, are angularly adjustable between the discs, whereby a changing of the flow characteristics will be possible.

DESCRIPTION OF PREFERRED EMBODIMENTS

Figure 1:
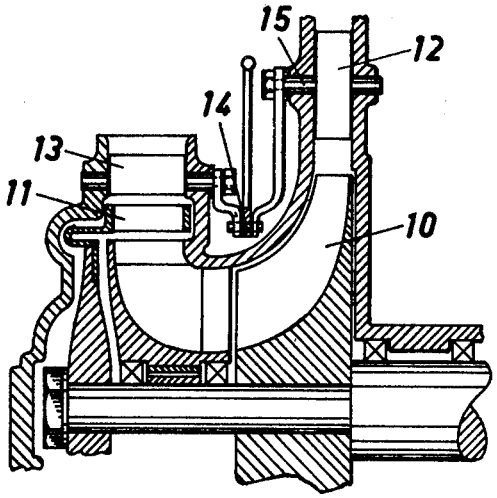
FIG. 1 is a fragmentary axial section of a two stage compressor provided with an outlet diffusor according to the invention.

The air compressor shown in FIG. 1 includes a conventional centrifugal compressor 10, as well as centripetal compressor 11 acting as a precompressor for the centrifugal compressor. A diffusor, generally denoted by 12, is provided at the outlet from the centrifugal compressor, and may be of any of the types to be described herebelow, having, as shown, adjustable channel defining segments. The centripetal compressor is provided with adjustable inlet vanes 13, and the operating mechanism 14 for the latter is operatively connected to an operating gear 15 for the diffusor segments, in such a manner that the inlet vanes and the diffusor segments will be adjusted simultaneously.

Figure 2:
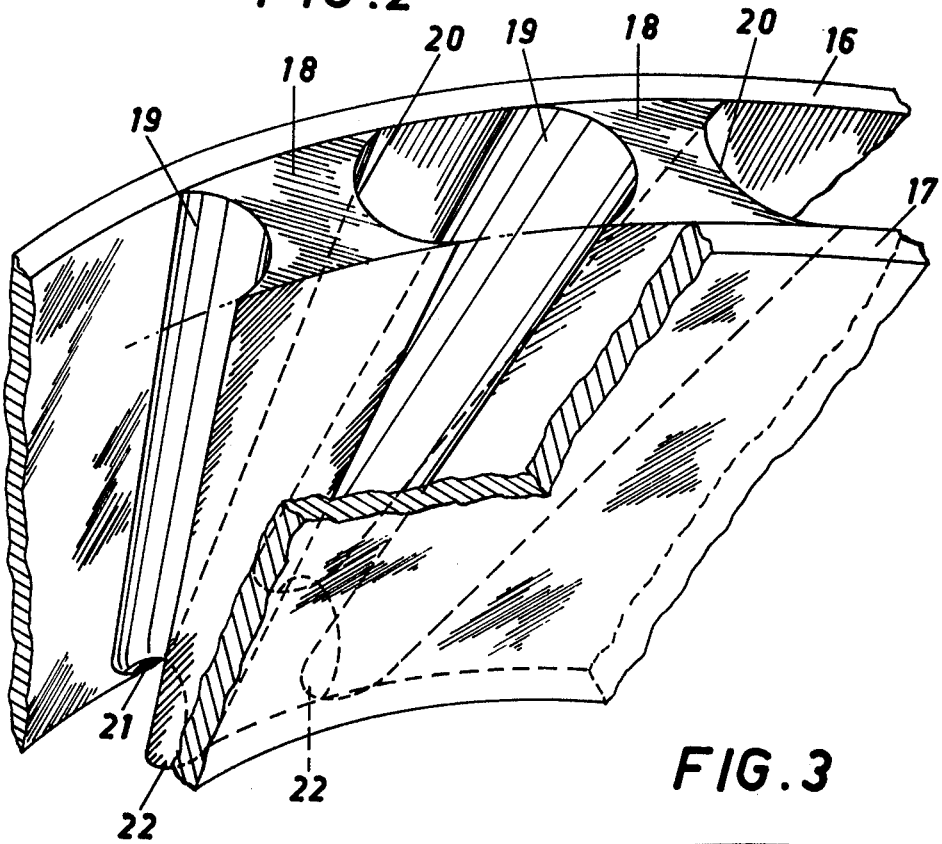
FIG. 2 is an enlarged fragmentary perspective view of a portion of the diffusor.

A portion of an outlet diffusor according to the invention, and having fixed passage defining segments, is schematically shown in FIG. 2. This diffusor includes two parallel, planar discs 16 and 17, respectively, as well as a number of elements 18 formed as segments of a circle fitted therebetween. Each segment 18 is defined by two plane side faces for abutment against the discs 16, 17, and are attached to the latter in arbitrary, known manner (not shown). Each segment is furthermore defined by two channel shaped edge faces 19 and 20, respectively. These channel faces may be formed as portions of the envelope surface of a cone or of a cylinder, or may have any other suitable geometric shape, whereby two adjacent segments between themselves will define a tubular expansion channel having slightly flattened side walls.

The two channel faces 19 and 20 merge into each other at the nose portion of the segment along an arcuate edge 21, the deepest portion of which, located about at a middle plane through the nose portion, will be noticeably retracted with respect to the geometric point of the segment. For practical reasons the radial lines defining the segments will not meet at a sharp point, but the nose portion is somewhat rounded as is illustrated at 22. An extended contact and sealing surface will thus be provided just at the nose portion of each segment, to each side of the edge, where the segment rests against the discs 16 and 17.

The gas flowing through a passage exerts a higher pressure at one side wall thereof than at the opposite wall, and if the pointed end of the segment is very narrow, a leakage from the side wall of one passage, subjected to the highest pressure to the low pressure side wall in the adjacent passage would occur. Hereby a substantial disturbance of the flow is brought about.

Figure 3:
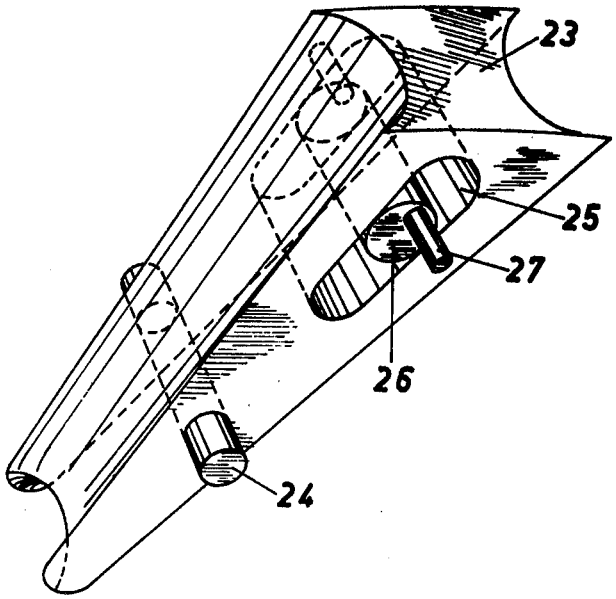
FIG. 3 shows a segment of the diffusor adapted for adjustment to alter the flow characteristics.

FIG. 2 shows, as has been mentioned, a fixed mounting of these segments. As is evident from FIG. 3, it is simple to arrange the segments in such a manner that they may be angularly displaceable with respect to the discs. Each segment 23 will then, adjacent to its nose portion, be provided with a trunnion pin 24, which is journalled in the discs. At its end remote from the nose portion, the segment is provided with a radially directed slot 25, into which an excentric member 26 is fitted. This member is mounted on a shaft 27, which extends through at least one of the discs 16 or 17, respectively, and is connected to the mechanism 15 mentioned in connection with FIG. 1 and making it possible to alter the inclination of the segments, while the compressor is in operation.

Figure 4:
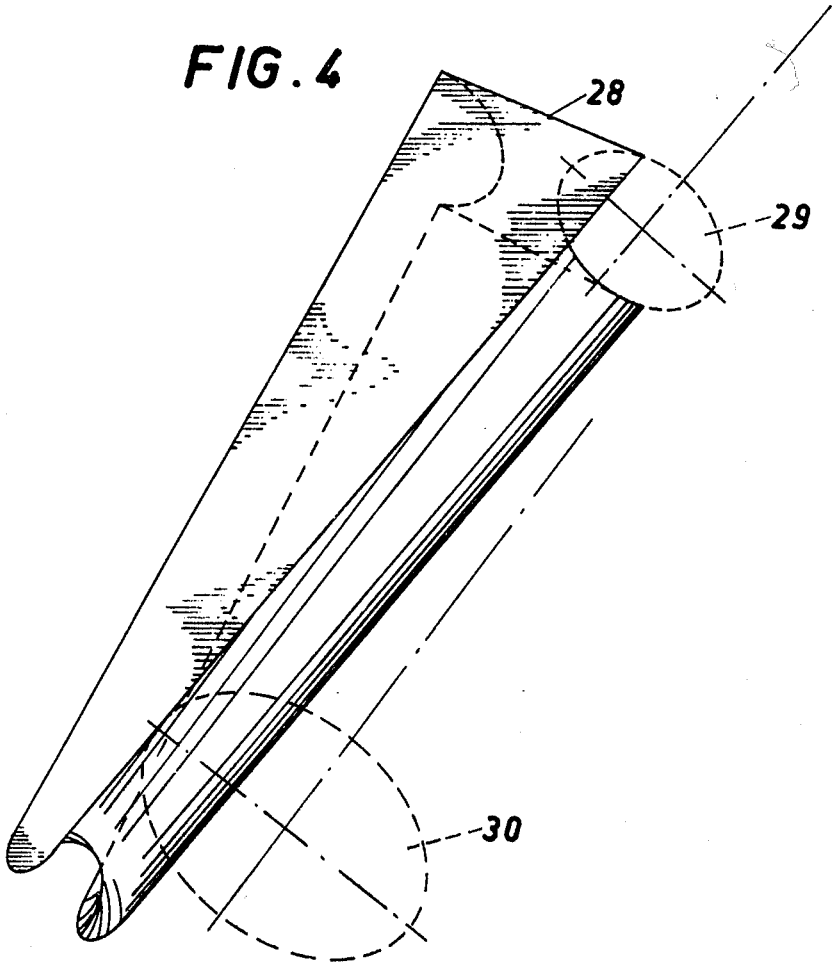
FIG. 4 shows a segment, similar to that of FIG. 2, but in which the channel shaped side faces are different.

The shape of the channel-shaped side faces may, as initially mentioned, vary in many ways. FIG. 4 shows an embodiment where the side faces of a segment 28 are formed as portions of the envelope surface of a cone, directed with its apex outwards from the center of the compressor. By a suitable arrangement of the spacing between the segments, it is possible, also with this embodiment, to obtain efficient tubular diffusor channels. As mentioned before, these side faces do not necessarily run straight between inlet and outlet, but may be arcuate according to any suitable geometric profile, while they of course simultaneously are channel shaped in cross section. In FIG. 4, a circle 29 denotes the cross sectional area through the cone at the outlet end of the segment, while circle 30 denotes the corresponding area a short distance upstream of the inlet.

Figure 5:
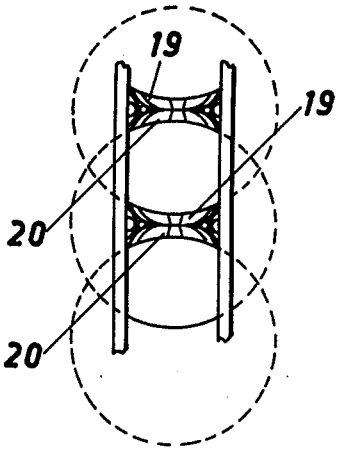
FIG. 5 is an end view of the inlets to adjacent passages taken substantially on the plane of line V—V of FIG. 6.

FIG. 5 shows a detail at the end portions at the entrances to adjacent passages, from which it is evident that the channel surfaces 19 and 20 are formed as portions of circles.

Figure 6:
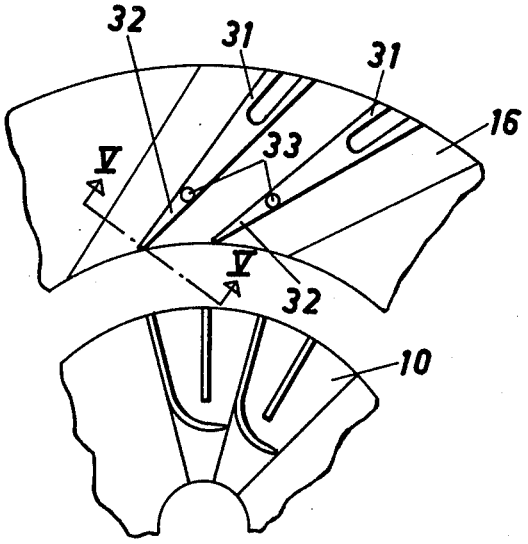
FIG. 6 shows a detail of a diffusor having segments, the nose portions of which are rounded.

FIG. 6 shows a further modification of the invention. The rotor of the compressor is denoted by 10, as in FIG. 1. The diffusor includes a number of segments 31, which in the manner above described are fitted between discs 16 and 17, respectively, of which only disc 16 is shown in FIG. 6. A main portion of each segment is fixedly mounted between the discs, but the nose portion 32 of each segment is angularly adjustable by means of a pivot 33, in such a manner that the shape of the inlet to each passage may be altered.

Figure 7:
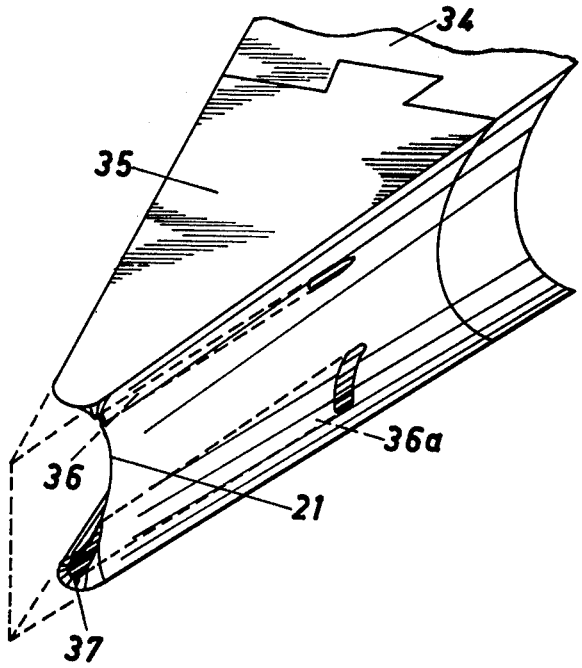
FIG. 7 shows a segment having a nose portion of wear resistant material and means for varying the inlet contraction during use.

FIG. 7 shows a further modification of a segment according to the invention. The main portion 34 may be manufactured from light metal, while the nose portion 35 is manufactured from a more wear resistant material, and is a dove-tailed into the main portion.

The arcuate edge line 21, which defines the contour of the nose merges into extended foot portions 37, joining the parallel side faces of the segment. In order to reduce the local contraction, which occurs at these portions, a passage 36 is bored, or formed in any other suitable manner, from each foot portion at the nose, upstream through the latter, and opens at the low pressure side of the segment, where the most critical boundary layer occurs. Simultaneously with reducing the contraction at the inlet it will be possible to bring about an advantageous acceleration of the boundary layer.

As the nose portions 35 may be manufactured by a casting process, or through a special machining, a high degree of flexibility in shaping the cross sections of the passages 36 is obtained. These may be designed otherwise than with the circular cross section provided through a boring operation. The passages may thus be designed with a triangular, or any other suitable cross section at the inlet, as well as along their extensions. A passage may possibly also be formed as a diffusor. In this manner it is possible to obtain two small built in diffusor passages from the foot portions of the segment. The outlet of a passage may be located and shaped in different ways, for instance as a slot, or the like, at the low pressure side of the segment, as indicated at 36*a* in the lower portion of FIG. 7.

These embodiments provide a desired tubular shape at the main diffusor, an extended latteral sealing surface and the possibility to use adjustable segments at tubular diffusors, avoiding disturbing blocking effects at the edges of the segments and a control of the boundary layer within the diffusor passages. Either of the contact faces between a disc and a segment may be covered by polytetrafluoreten or similar material, which is sprayed upon the surface, or is fitted into recesses. The passages may furthermore also be covered by such material.

I claim:

1. An outlet diffusor in combination with a centrifugal compressor comprising a rotor for discharging radially and tangentially of the axis of rotation of the rotor, the diffusor comprising parallel, planar discs having an inner and outer periphery circumposed about the rotor, a plurality of individual separated elongated passage-forming elements circumferentially spaced, transversely between said discs, said elements comprising opposed planar, parallel side faces defining a segment of a circle along their length and extending in juxtaposed relation on the opposed inner surfaces of said discs and substantially from the inner to the outer periphery of said discs, said elements including opposed channel shaped edge faces converging in a concave transverse edge between said side faces and adjacent the inner periphery of said discs, the parallel side faces of the elements terminating in a rounded ends flanking the transverse edge at the inner periphery of the discs, the channel shaped edge faces merging into each other along the transverse edge, adjacent edge faces of adjacent elements combining to form divergent expansion passages from the inner to the outer periphery of said discs.

2. The structure according to claims 1, in which each element is pivotably mounted on the discs by means of a trunnion pin located adjacent to its inner end, each element being provided with an elongated slot, remotely located with respect to the said pin, and means operatively connected in said slots for adjusting the angular position of the element, relative to the outer periphery of said rotor.

3. The structure according to claim 1, in which each element includes a rear portion which is fixed in relation to the discs and an inner portion including the transverse edge, said inner portion being angularly displaceable with respect to a pivot located in the plane separating the two portions of the segment, whereby the entrance of the diffusor passages is adjustable.

4. The structure according to claim 2 including an inlet portion for the centrifugal compressor, adjustable inlet vanes, operatively associated with said inlet portion, the means for adjusting the position of the diffusor elements being operatively connected to means for adjusting the position of the inlet vanes.

5. The structure according to claim 1 in which the transverse arcuate edge by way of the flanking rounded ends merge into the parallel side faces of the elements, and a passage, extending from each of said rounded ends runs within the element for a distance upstream of the transverse edge, and opens at the low pressure side of the element.

6. The structure according to claim 1 in which said elements comprise a separate main portion and nose portion, and means connecting said main and nose portions in integrated relationship, said nose portion comprising a material of greater wear resistence than said main portion and being replaceable if excess wear occurs.

* * * * *